US010045668B2

(12) United States Patent
Green et al.

(10) Patent No.: US 10,045,668 B2
(45) Date of Patent: Aug. 14, 2018

(54) METHOD AND SYSTEM FOR AUTHENTICATION OF A PAPER PRODUCT IN A DISPENSER

(71) Applicant: Kimberly-Clark Worldwide, Inc., Neenah, WI (US)

(72) Inventors: Jonathan Green, Warlingham (GB); Stephen Becker, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 15/552,630

(22) PCT Filed: Feb. 25, 2015

(86) PCT No.: PCT/US2015/017432
§ 371 (c)(1),
(2) Date: Aug. 22, 2017

(87) PCT Pub. No.: WO2016/137451
PCT Pub. Date: Sep. 1, 2016

(65) Prior Publication Data
US 2018/0042431 A1 Feb. 15, 2018

(51) Int. Cl.
*A47K 10/36* (2006.01)
*A47K 10/42* (2006.01)

(52) U.S. Cl.
CPC ..... *A47K 10/3662* (2013.01); *A47K 10/424* (2013.01)

(58) Field of Classification Search
CPC ..... A47K 10/3662; A47K 10/424
USPC ..... 700/231–244
See application file for complete search history.

(56) References Cited

U.S. PATENT DOCUMENTS

| | | | | |
|---|---|---|---|---|
| 7,040,566 | B1 | 5/2006 | Rodrian et al. | |
| 7,780,380 | B2 | 8/2010 | Nagaya et al. | |
| 8,146,775 | B2 * | 4/2012 | De Jong | A47K 10/28 221/11 |
| 8,165,716 | B1 | 4/2012 | Goeking et al. | |
| 8,511,598 | B2 * | 8/2013 | Neveu | A47K 10/16 242/563 |
| 9,717,377 | B2 * | 8/2017 | Cattacin | A47K 10/3662 |

(Continued)

FOREIGN PATENT DOCUMENTS

JP 2000-281268 A1 10/2000

OTHER PUBLICATIONS

PCT Search Report, dated Nov. 4, 2015.

*Primary Examiner* — Michael Collins
(74) *Attorney, Agent, or Firm* — Dority & Manning, P.A.

(57) ABSTRACT

A system and control method are provided for authenticating a paper product dispensed from a dispenser. The paper product formation is loaded into the dispenser, the formation having an identification mark engraved into a surface thereof. Within the dispenser, incident light is directed onto the surface and a digital image of the surface is captured. The engraved identification mark produces a recognizable authentication signature in the digital image as compared to surrounding surface of the paper product formation. The captured digital image is analyzed for presence of the authentication signature, and if the authentication signature is not present, the paper product formation is deemed unauthorized and a responsive action is initiated.

9 Claims, 6 Drawing Sheets

(56) References Cited

U.S. PATENT DOCUMENTS

| | | | | |
|---|---|---|---|---|
| 2006/0173576 | A1* | 8/2006 | Goerg | A47K 10/3845 700/236 |
| 2009/0177315 | A1* | 7/2009 | Goeking | A47K 10/34 700/231 |
| 2010/0114366 | A1* | 5/2010 | Case | A47K 10/36 700/232 |
| 2010/0268381 | A1 | 10/2010 | Goerg et al. | |
| 2013/0119183 | A1 | 5/2013 | Cattacin et al. | |
| 2013/0193248 | A1* | 8/2013 | Orozco Ramirez | B65H 18/28 242/160.1 |

* cited by examiner

METHOD AND SYSTEM FOR AUTHENTICATION OF A PAPER PRODUCT IN A DISPENSER

FIELD OF THE INVENTION

The present invention relates generally to methods and systems for dispensing consumable paper products, such as rolled or stacked towels, from a dispenser wherein the authenticity of the product is verified prior to dispensing.

BACKGROUND

Whether for private home use or public use, the dispensing of paper products such as towels and tissues has resulted in many different types of manual and automatic dispensing devices for controlling quantities dispensed, as well as for determining how much of the paper product has been dispensed. For example, U.S. Pat. No. 7,780,380 describes a dispenser of stacked paper products (e.g., folded and stacked napkins or paper towels) wherein a sensor unit is carried by an inner side wall of the dispenser housing and is used for detecting when refill of the dispenser is needed. Such dispensers, however, generally lack the ability to identify whether the refill product is authorized for use with the dispenser. Unauthorized or unapproved products may be of an inferior quality and can result in jamming or other disruptive issues. The practice of refilling a proprietary dispenser with a less expensive and lower quality product is often referred to in the industry as "stuffing".

Thus, methods and systems have been proposed to provide a dispenser that "locks-out" or disables the dispenser if the product is not authenticated. For example, U.S. Pat. No. 8,165,716 discloses a method of dispensing a product that includes determining by a processor if the product loaded into a dispenser is authorized for use in the dispenser by identifying a reference indication associated with the product. In particular, the method includes exciting a pigment in a reference indication on the product with a first light. A second light is emitted by the pigment. A first light intensity is measured of the second light at a first time, and a second light intensity is measured of the second light at second time. A change in light intensity is calculated from the first time to the second time and is compared to a predetermined value to authenticate the product. In response to determination that the product is authorized, a first amount of the product is dispensed. If the determination is made that the sheet product is unauthorized, a second lesser amount of sheet product is dispensed.

Accordingly, the industry is continuously seeking new and improved dispensing systems that can accurately authenticate a product without prohibitively adding to the cost of the dispenser or the refill product, or adversely affecting the product dispensing operation.

SUMMARY OF THE INVENTION

Objects and advantages of the invention will be set forth in part in the following description, or may be obvious from the description, or may be learned through practice of the invention.

In accordance with aspects of the invention, a dispenser system and method are provided for authenticating a paper product dispensed from a dispenser, particularly a refill product wherein the paper product is initially loaded in the dispenser as a paper product formation, such as a roll of a continuous tissue or paper towels, or a stack of folded napkins. It should be understood that the present system and method are not limited to a particular type or configuration of dispenser, or type of paper product dispensed. The inventive systems and methods are, however, particularly useful when integrated with consumable paper product dispensers (e.g., manual or automatic toilet tissue dispensers, paper towel dispensers, and folded napkin dispensers) typically found in an "away-from-home" public or semi-private environment. As used herein, the term "away-from-home" means a place or location where people congregate for various reasons or purposes that are outside the typical home. Examples of away-from-home locations include places of business, such as office buildings, office suites, retail stores, and warehouses, manufacturing facilities; schools; hospitals and other types of medical facilities; places of worship; hotels and motels; conference centers; and the like. The system is particularly useful in structures wherein multiple washroom facilities are provided for use of the building tenants or an industrial or manufacturing site wherein multiple site facilities are provided for a controlled populace. It should be appreciated though that the present washroom system may prove useful in a residential or private environment, and such uses are within the scope and spirit of the invention.

The method includes loading the paper product formation into the dispenser (initial or refill product), wherein the paper product formation has an identification mark engraved into a surface of the paper product formation, for example on a side or edge of the product. Within the dispenser, an incident light is directed onto the surface and a digital image of the irradiated surface is captured with an imager. The engraved identification mark produces a recognizable authentication signature in the digital image as compared to surrounding surface of the paper product formation. The captured digital image is then analyzed for presence of the authentication signature. If the authentication signature is not present, the paper product formation is deemed to be a counterfeit or unauthorized product and a responsive action is initiated.

In a particular embodiment, the identification mark is defined with a laser into the surface of the paper product formation via a suitable laser engraving system that may be incorporated in the production line of the paper product formations. Conventional laser engraving systems are well known and provide the capability for precise depth control and pattern generation on a wide variety of materials, including natural fiber products.

In certain embodiments, the dispenser may be a rolled product dispenser and the paper product formation is a roll of a continuous paper product, as commonly used and known in the art. With this type of product formation, the identification mark may be defined on a side surface of the roll.

In an alternate embodiment, the dispenser may be a stacked product dispenser and the paper product formation is a stack of folded paper products with the identification mark extending along a side surface of the stack.

The engraving technique used to form the identification mark may result in a mark that is essentially color-wise indistinguishable from the surrounding surface of the paper product formation and thus generally not visible to a user or maintenance person, but may have a tactile characteristic that is perceived by such person. Alternatively, the engraving technique may result in a visually detectable mark. For example, a laser engraving process may produce a visually discernable "burn" mark engraved into the surface.

The dispenser may be any well-known electronic dispenser that detects the presence of a user and automatically dispenses a measured sheet of the paper product. With this type of dispenser, the responsive action may include engaging a partial or full lock-out feature wherein the dispenser is disabled from dispensing some or all of product from the paper product formation. In one embodiment, the dispenser may communicate pending engagement of the lock-out feature to a remote central monitoring station that generates a corrective action call to maintenance personnel. With this embodiment, engagement of the lock-out feature may be time-delayed so that the maintenance personnel have an opportunity to replace the unauthorized paper product formation with an authentic paper product formation.

Various digital imaging techniques may be used to detect and validate the presence of the authentication signature. For example, the depth or other surface contour of the engraved mark may produce a distorted reflected light pattern as compared to the surround surface of the paper product formation. This distorted light pattern may produce measurable characteristics in the captured digital image that are compared to a known or "standard" value for a valid authentication mark. For example, the digital image may be analyzed for a dimension (e.g., length) or pixel count of the authentication signature that is compared by a processor with a known dimension or pixel count value corresponding to a valid authentication mark.

DETAILED DESCRIPTION OF THE INVENTION

Figure 1:
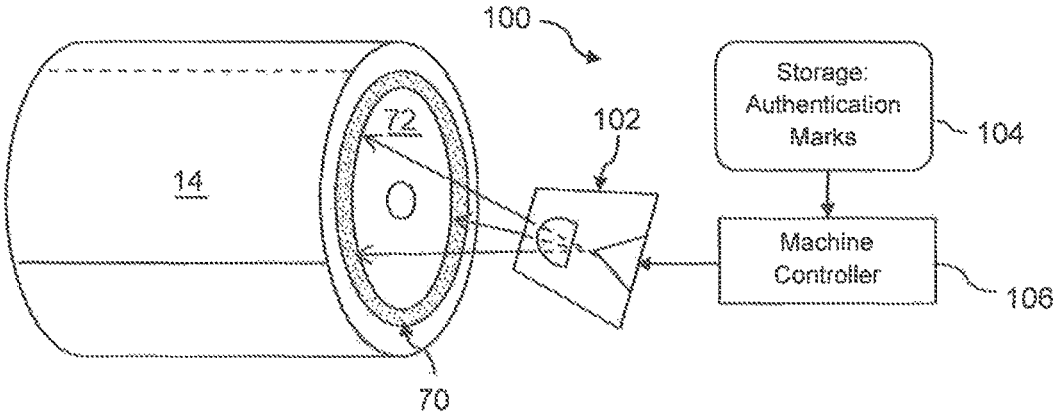
FIG. 1 is an operational principle diagram of a system and method for engraving an authentication mark into a surface of a paper product formation in accordance with system and method aspects of the present invention.

Reference will now be made in detail to one or more embodiments of the invention, examples of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Figure 2:
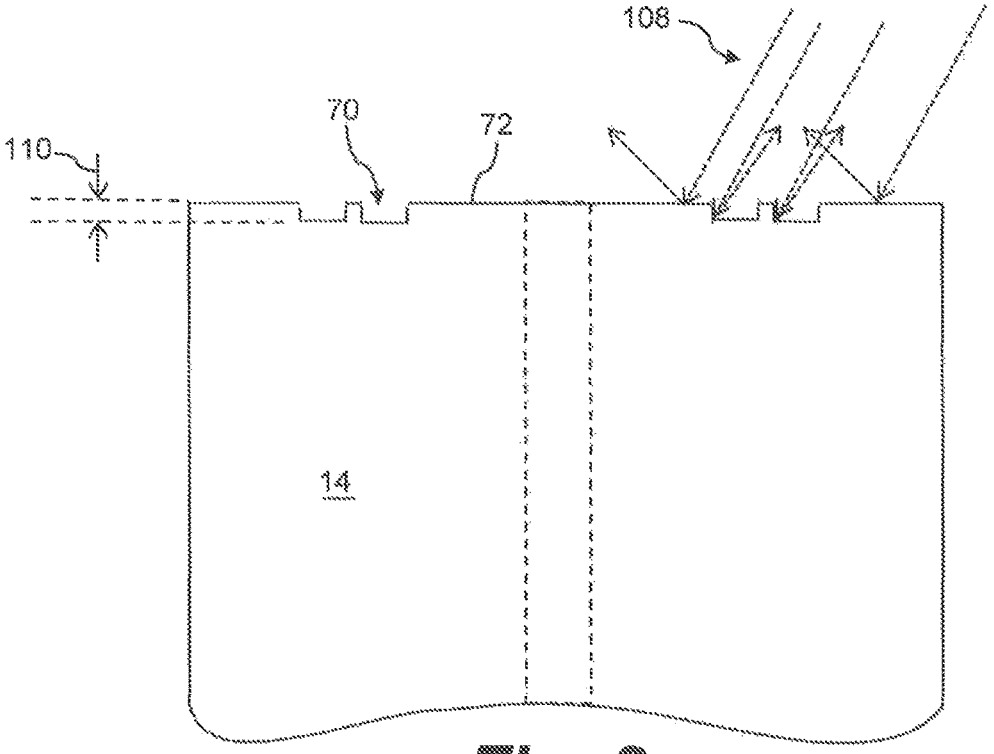
FIG. 2 is a side operational principle view of a system and method for detecting an engraved authentication mark on a paper product formation.

FIGS. 1 and 2 depict certain operational principles of system and method embodiments within the scope of the present invention. In FIG. 1, a paper product formation 14 ("formation") is illustrated as a rolled product formation of the type typically used with paper towel dispensers in public washroom facilities. The paper product formation 14 may be a refill product that is loaded into an empty or depleted dispenser and is typically formed as a continuous rolled web of perforated or unperforated sheets. An authentication mark 70 is engraved into a surface aspect 72 of the formation 14, such as the side aspect of the formation 14 depicted in FIG. 1. This mark 70 may take on any desired shape, form, pattern, or the like. For example, the mark 70 may be a proprietary mark of the manufacturer of the dispenser or formation 14. In the illustrated embodiment, the mark 70 is a circumferential band or stripe that extends completely around the side aspect 72. The mark 70 may be a continuous mark, as in FIG. 1, or a discontinuous mark, such as a series of individual spaced apart symbols. A continuous mark 70 may be preferred in that it is ensured that the mark 70 is detectable in a static digital image field regardless of the initial loaded position of the formation 14 within the dispenser.

Referring also to FIG. 2, the mark 70 is engraved into the surface aspect 72 of the formation 14 to the extent that it has a depth 110 relative to the outer planar surface of the aspect 72. The value of this depth 110 will vary depending on the type of engraving process, type of material, and so forth, and can be readily determined by those skilled in the art. The depth 110 of the engraved mark 70 is sufficient to generate a distortion or disruption of reflected light from an incident light 108 as compared to the surrounding surface of the aspect 72. In other words, the incident light 108 that is directed into the engraved mark 70 will reflect differently as compared to the incident light 108 that reflects directly from the surface aspect 72, as graphically depicted in FIG. 2. This distorted or disrupted reflected light pattern will produce a detectable anomaly or characteristic in a digital image taken of the surface aspect 72 that can be analyzed for to verify the presence of the engraved mark 70 on the product formation 14.

The engraving process used to produce the mark 70 may also alter the reflective properties of the engraved surface of the mark 70 as compared to the surrounding surface aspect 72, and thus add to the detectable reflected light pattern from the mark 70. For example, the process may result in the mark 70 having a more reflective "polished" finish as compared to a less-reflective surface aspect 72.

Referring again to FIG. 1, an engraving system 102 is graphically depicted. In a particular embodiment, this system 102 is a laser engraver controlled by a machine controller 106. A laser engraving station may be incorporated into any suitable manufacturing process of the formation 14 wherein the surface aspect 72 is exposed for engraving. Laser engraving machines and techniques are well known and need not be described in detail herein for an understanding and appreciation of the present invention. A laser beam is highly focused and collimated can be precisely controlled to remove (e.g., vaporize) an exact amount of the product in the formation 14 to achieve the desired depth 108 of the mark 70. The machine controller 106 can generate generally any desired pattern of mark 70, typically through use of one or rotating or vibrating mirrors that trace the laser beam into a desired pattern on a surface.

The controller 106 may include a library 104 of marks that can be readily interchanged for different batch runs of the product formation 14. In this manner, the mark 70 can change at various random times, thereby deterring counterfeiters from mass producing counterfeit refill products. So long as the dispenser controller in which the product formations 14 are loaded are updated with the current valid mark 70, the mark can be changed as often as desired.

Figure 3:
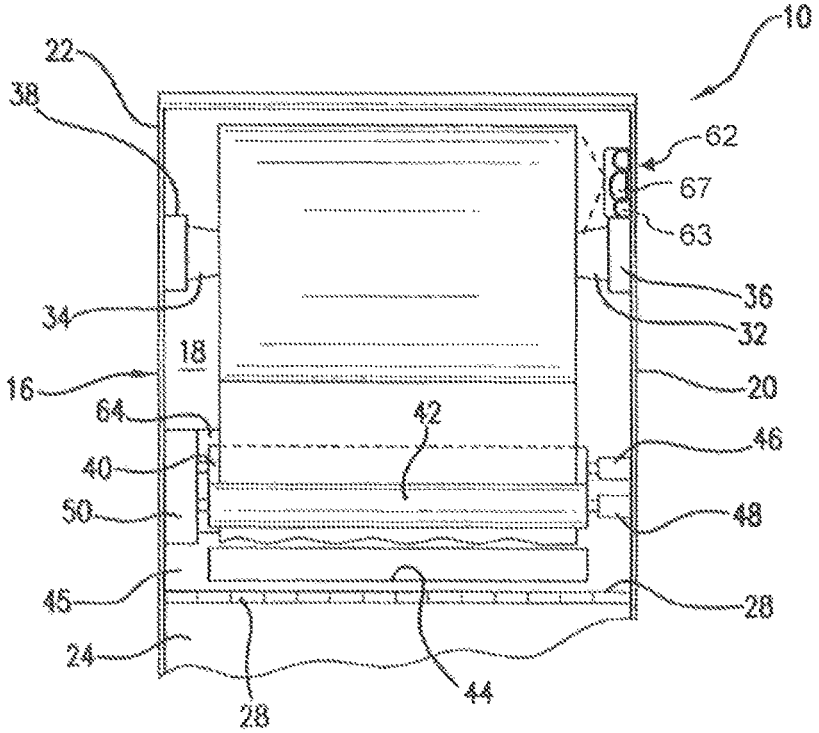
FIG. 3 is a front view of an exemplary paper product dispenser with a digital imager for detecting the presence of an authentication mark on the side of a rolled paper product formation.
Figure 4:
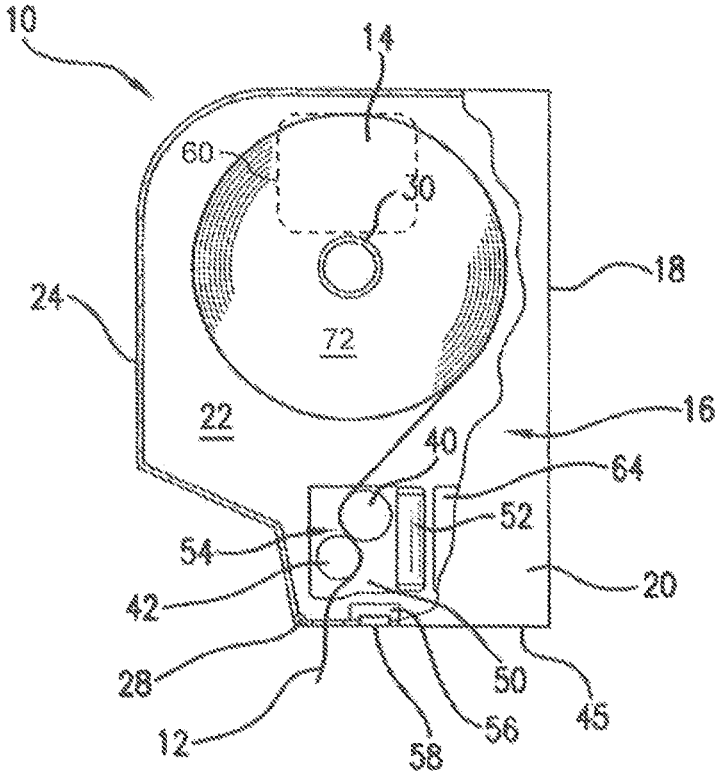
FIG. 4 is a cut-away view of the dispenser of FIG. 3 and indicates the field of a digital image obtained by the digital imager.

Various embodiments of a dispensing system and method within the scope of the invention are depicted in the figures. With reference to FIGS. 3 and 4, an automatic electronic dispenser system 10 is illustrated for dispensing a paper product in the form of sheet material 12 from a paper product formation 14 loaded into the dispenser, such as a continuous roll of the sheet material. The paper product 12 in this embodiment is an absorbent material, such as paper toweling or toilet tissue, and so forth, which may be perforated for separation. The dispenser system 10 includes a dispenser housing 16 having a back panel 18 mountable to a wall or similar vertical surface, a pair of opposed side panels 20 and 22, and a front cover 24. The front cover 24 may be pivotally connected to a lower portion of the housing 16 with hinges 28 so as to be movable between a closed condition and an open condition. The front cover 24 of the dispenser housing 16 typically is opened for servicing or for loading a replacement sheet material roll 14 into the dispenser 10. A latch (not shown) allows the front cover 24 to be locked in the closed condition so as to avoid unauthorized tampering with the dispenser components within the housing 16.

The paper product formation 14 depicted as a "roll product" in FIGS. 3 and 4 may include a core or sleeve 30, or may be a coreless roll, such as that disclosed in U.S. Pat. No. 5,620,148. The roll product 14 may be rotatably supported within the housing 16 by a pair of mounting hubs 32 and 34 which, in the illustrated embodiment are connected to the side panels 20 and 22 of the housing 16 by means of roll holders 36 and 38. The outer circumference of the roll product 14 may be supported by a portion of the housing without other support for unwinding of the roll 14, as disclosed for example in U.S. Pat. No. 6,224,010. It will be appreciated, however, that the housing 16 may be provided as a separate unit with few or no mechanisms connected thereto. In this instance, some or all of the dispensing mechanisms shown and/or described herein may be provided as one or more modules which are inserted into the housing. Examples of such dispenser housings and modules are disclosed in U.S. Pat. Nos. 4,131,044 and 6,079,035.

As depicted in FIGS. 3 and 4, the sheet material 12 runs off the roll product 14, between a pair of rollers 40 and 42, and through a dispensing opening 44, for example, in a lower end 45 of the housing 16. Alternatively, the dispensing opening may be formed in the front cover, or in both a portion of the front cover and a portion of the lower end (not shown). The opening 44 may have a serrated edge, or it may carry teeth for severing the web of sheet material (if the material 12 is not perforated). One end of the roller 40 may be rotatably mounted to the side panel 20 of the housing 16 by means of a roll holder 46, and one end of the roller 42 may be rotatably mounted to the side panel 20 of the housing 16 by means of a roll holder 48. The other ends of the rollers 40 and 42 may be rotatably mounted to the side panel 22 by means of roll holders concealed within a transmission housing 50. The transmission housing 50 contains a transmission for transmitting drive from an electric motor 52 to the roller 40 so as to rotationally drive the roller.

The rollers 40 and 42 together define a nip 54 having a gap which is desirably slightly smaller than the thickness of the sheet material 12 on the roll product 14. The sheet material 12 passes through the nip 54 so that rotation of the drive roller 40 and the driven roller 42 pulls the sheet material off of the roll 14 and dispenses it through the dispensing opening 44.

An activation sensor 56 may be mounted to the lower end 45 of the housing 16 (or, alternatively, to a module in the housing) adjacent a lens 58, as illustrated in FIG. 1. It will be understood, however, that the activation sensor 56 and/or lens 58, or any activations system known in the art, may be mounted in any area of the housing 16. The sensor 56 may be a conventional passive sensor for detecting infrared radiation. Passive infrared detectors are known in the art, and are described, for example, in U.S. Pat. No. 4,757,337. In practice, the sensor 56 is arranged to detect infrared radiation from a user's hand placed below the lens 58, and upon detecting the radiation, to transmit a signal for activating the electric motor 52 so as to dispense a length of sheet material through the dispensing opening 44.

In alternate embodiments, the sensor 56 may be an active device that emits an active signal to detect the presence of a user at or near the dispenser. Such active sensing systems are also well known to those skilled in the art.

Figure 7A:
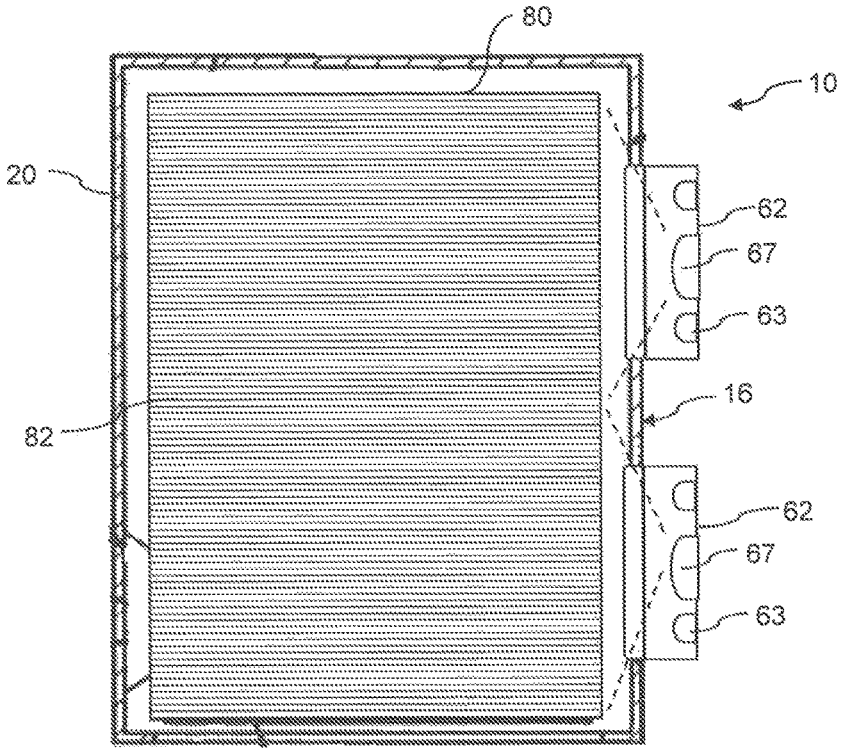
FIGS. 7*a* and 7*b* are front and side views of a stacked paper product formation within a dispenser, wherein the authentication mark is engraved into a side surface aspect of the stack.
Figure 7B:
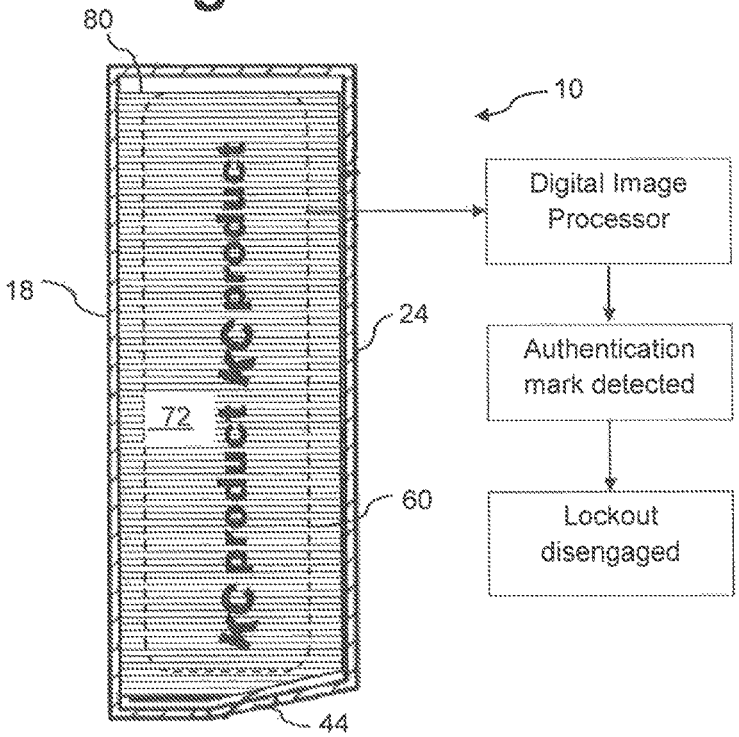
Figure 8:
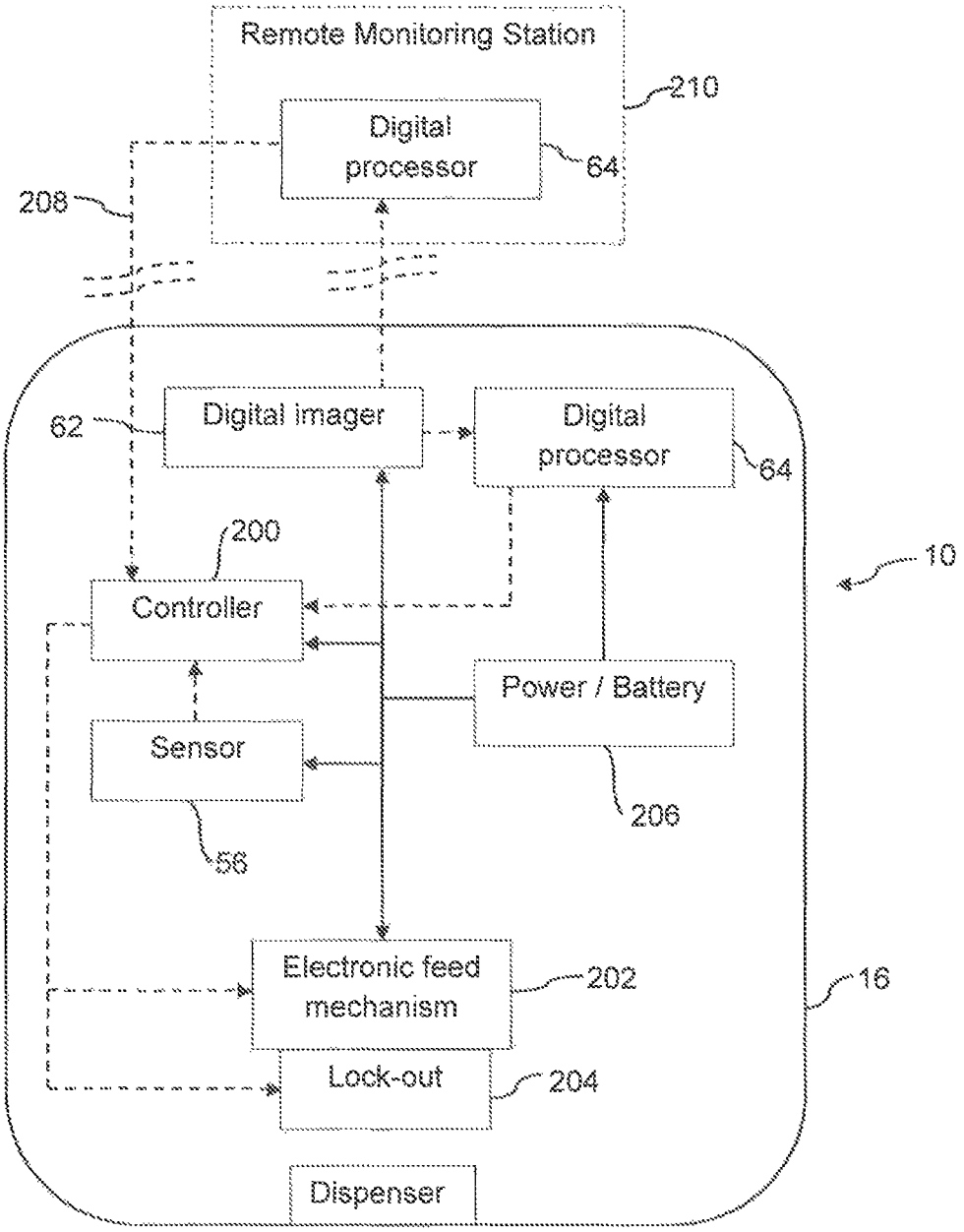
FIG. 8 is a diagram view of control functions and components of a dispenser incorporating features of the present invention.

Aspects of the present system and method embodiments utilize digital imagining and processing techniques that are known to those skilled in the art of digital imagery. Referring to the figures in general and discussed in greater detail below, one or more digital imagers 62 are utilized with a dispenser system 10 to generate a digital image 60 (e.g., FIGS. 4, 5*a* and 5*b*) of an aspect of the paper product formation 14, such as the side of the roll product in FIG. 4 or a side of a stacked product 80 (FIG. 7*b*), in the dispenser 16. The digital imager 62 may be any suitable and commercially available digital camera 67 and light source 63, such as an array of one or more LED lights. The digital camera 67 has a sufficient pixel density and resolution for the purposes described herein. The digital imager 62 may be mounted and oriented within the dispenser housing at a location to periodically generate the digital image 60 of an aspect of the paper product formation 14, 80, such as the side aspect 72. FIGS. 4 and 7*b* show in dashed lines the field of the digital image taken by the imagers 62 relative to the side 72 of the paper product formations 14, 80. The digital imagers 62 may be mounted completely within the dispenser housing 16, or may be mounted to the outside of the housing 16 with a lens that protrudes through a side wall 20, 22 of the housing, as depicted in the embodiment of FIG. 7*a*.

The digital imager 62 includes the digital camera 67 with a defined imaging field 60 that captures a digital image of the surface aspect 72 containing the mark 70. The digital images 60 are transmitted to a digital image processor 64, which may be incorporated directly as a component of the dispenser system 10 or remotely located and common to a plurality of dispensers 16. The digital image processor 64 is configured with sufficient processing capability to analyze and differentiate the light pattern from the mark 70 as compared to the surrounding surface aspect 72. This differentiation may be detected by pixels that define an edge or other aspect of the mark 70 within the digital image 60. In some embodiments as described herein, the digital image processor 64 may conduct a count of pixels above a certain pixel threshold value that are known to be produced by the engraved mark 70. This count can then be compared to predetermined count values for known valid marks 70 to authenticate the product formation 14. Other aspects of the light reflected from the engraved mark 70 may be analyzed as well. For example, the digital imager processor 64 may also determine a dimensional value of a feature captured in the digital image 60 that is produced by the engraved mark 70.

Certain embodiments may rely on known edge detection techniques in digital image processing, which are mathematical methods that identify points in the image at which brightness changes relatively sharply (e.g., brightness discontinuities). The result of applying an edge detector technique to an image leads to a set of connected curves that indicate boundaries of objects in the image. Applying an edge detection algorithm to an image may significantly reduce the amount of data to be processed and filter out information that is less relevant, while preserving important structural properties of an image. The edges extracted from a two-dimensional image of a three-dimensional object can be classified as either viewpoint dependent or viewpoint independent. Relevant to the present disclosure, a viewpoint independent edge typically reflects inherent properties of the three-dimensional object, such as surface markings and surface shape. A typical edge might be the border between a block of red color against a yellow or white background.

There are many methods for edge detection, but most are grouped into two categories, search-based and zero-crossing based. The search-based methods detect edges by first computing a measure of edge strength, usually a first-order derivative expression such as the gradient magnitude, and then searching for local directional maxima of the gradient magnitude using a computed estimate of the local orientation of the edge, usually the gradient direction. The zero-crossing based methods search for zero crossings in a second-order derivative expression computed from the image in order to find edges, usually the zero-crossings of the Laplacian or the zero-crossings of a non-linear differential expression.

As a pre-processing step to edge detection, a smoothing stage, typically Gaussian smoothing, is almost always applied. Known edge detection methods mainly differ in the types of smoothing filters that are applied and the way the measures of edge strength are computed. As many edge detection methods rely on the computation of image gradients, they also differ in the types of filters used for computing gradient estimates in the x- and y-directions.

It should be appreciated that those skilled in the art of digital image processing are well versed in techniques that may be implemented for purposes of the present invention.

Figure 5A:
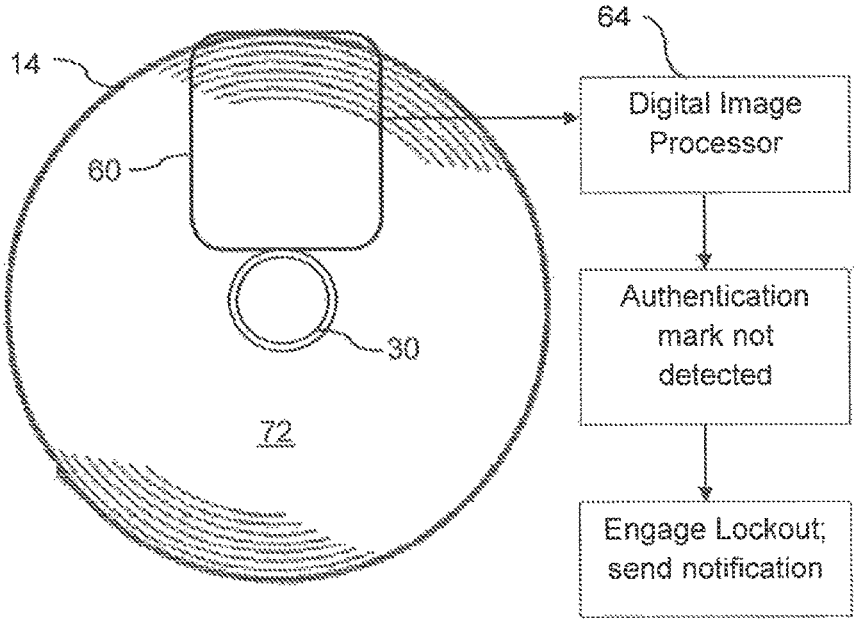
FIGS. 5*a* and 5*b* are side views of a rolled paper product formation indicating a digital image taken of the full roll with and without an authentication mark, respectively.
Figure 5B:
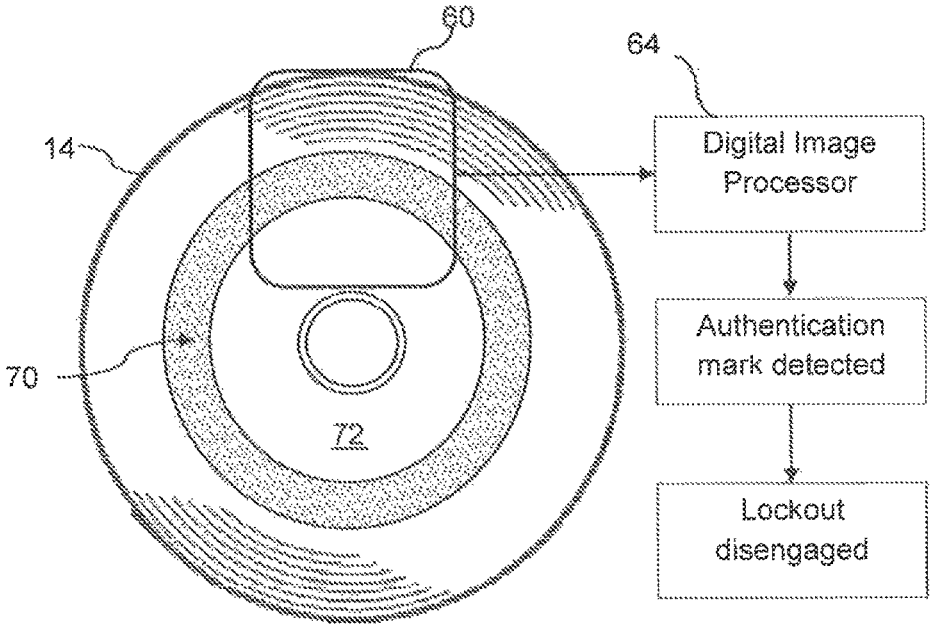

FIGS. 5*a* and 5*b* related to a method and system embodiment relevant to the roll product dispensing system 10 depicted in FIGS. 3 and 4. FIG. 5A illustrates the side aspect 72 of the roll paper formation 14. The digital imager 62 in FIG. 3 is disposed above the roll hub 32 and roll holder 36 so as to capture the digital image 60 depicted in FIG. 5A. The digital image 60 essentially captures a surface area of the roll product formation 14 at a full condition of the product 14 where a mark 70, if applied to the product 14, would be present. In this particular embodiment of FIG. 5*a*, the digital image 60 is transmitted to the image processor 64 wherein the image is analyzed for presence of the mark 70. As the mark is not detected in the image 60, the product formation 14 is deemed to be a counterfeit (e.g., not authentic or unauthorized) and a command is generated or issued for a corrective action. As discussed above, this action may include engaging a partial or full lock-out feature wherein the dispenser is disabled from dispensing some or all of product from the paper product formation. In one embodiment, the dispenser may communicate pending engagement of the lock-out feature to a remote central monitoring station that generates a corrective action call to maintenance personnel. With this embodiment, engagement of the lock-out feature may be time-delayed so that the maintenance personnel have an opportunity to replace the unauthorized paper product formation with an authentic paper product formation.

Still referring to FIG. 5*a*, the digital image 60 may be transmitted to the digital image processor 64 via a wired or wireless connection depending on the location of the digital image processor. In this regard, the digital imager 62 includes sufficient hardware/software to carry out transmission of the image to the digital signal processor 64 in the event that the processor 64 is not incorporated as a component of the digital imager 62.

Initial calibration steps may be conducted with marks 70 of various design, size, etc., on various materials making up the product formation 14 in order to obtain a comparative standard for the individual marks 70. These standard values are stored and accessible by the processor 64 upon updating the processor 64 with a current valid mark 70.

FIG. 5*b* illustrates the roll product formation 14 having a valid mark 70 defined in the side aspect 72 as a continuous circumferential stripe. This type of continuous mark may be desired in that, regardless of the initial rotational position of the product formation 14, it is ensured that the mark falls within the field of the digital image 60. The image 60 is transmitted to the processor 64, which detects the presence of a valid mark 70, wherein authentication of the product formation 14 is completed and it is ensured that the lockout feature (or other corrective action) is disengaged and normal dispense operations are enabled.

Figure 6:
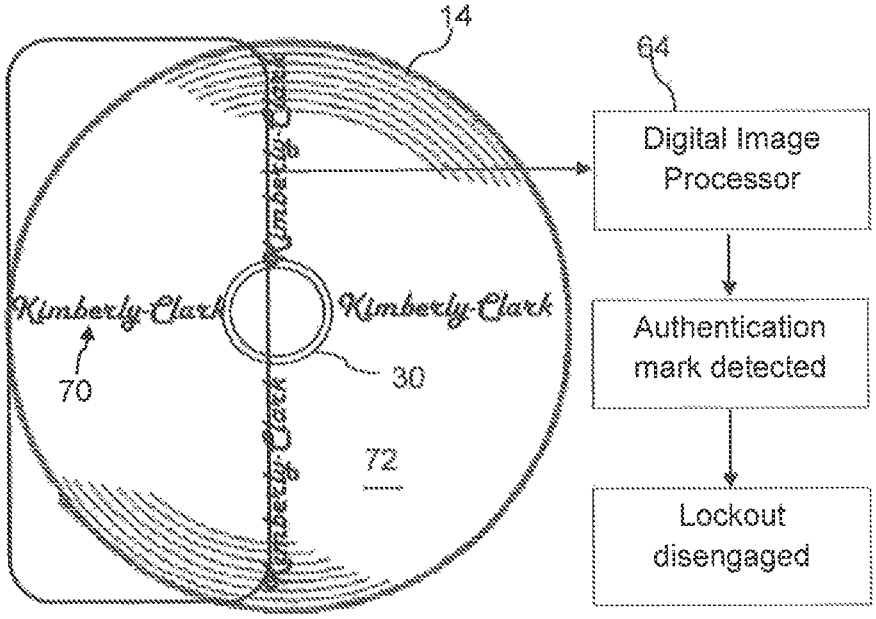
FIG. 6 is a side view of a rolled paper product formation having a plurality of authentication marks engraved therein, with at least one mark captured in the field of the digital image.

FIG. 6 depicts an embodiment wherein a plurality of the marks 70 engraved into the surface aspect 72 of the roll product formation 14 is a name or logo of a manufacturer of the product 14, or of the dispenser in which the product 14 is intended for use. The marks 70 are arranged in a spoke pattern. The field of the digital image 60 in this embodiment is larger and encompasses essentially half of the surface area of a full product 60. The digital imager 62 within the dispenser may include multiple cameras 67 that combine images to generate the larger image 60. The pattern of the marks 70 ensures that, regardless of the rotational position of the product 14 when loaded into the dispenser, at least one of the marks 70 is present in the field 60. Authentication is verified if one or more of the marks 70 is detected and corrective actions are not initiated.

FIG. 7*a* 7*b* depict a dispensing system 10 that is configured for dispensing a stacked paper product formation 80, such as a stack of interleaved and folded paper towels 82. FIG. 7*b* depicts the side aspect of the dispenser system 10 wherein the side 72 of the stacked product formation 80 is visible, as well as the field of the digital image 60. In FIG. 7*a*, it can be appreciated that multiple digital imagers 62 may be aligned along the side 22 of the dispenser 16, wherein the respective images of the individual imagers 62 are combined to generate the digital image 60 depicted in FIGS. 7*a* and 7*b*.

Referring to FIG. 7*b*, the mark 70 is engraved into the side aspect 72 of the stack in the form of repeating words, symbols, and the like, for example the name or logo of a company. The image 60 is analyzed for the mark 70 as discussed above.

FIG. 10 is a diagram illustrating various component functionalities of the systems and method. In the illustrated embodiment, the system 10 includes the dispenser 16 having the digital processor 64 and imager 62 incorporated with the individual dispenser 16. Power is supplied externally or internally via a battery 206 to the various components, including the digital processor 64, digital imager 62, dispenser controller 200, sensor 56, and an electronic feed mechanism 202. As discussed above, aspects of the present method and system may be incorporated with any manner of conventional dispenser utilizing conventional electronic feed mechanisms 202. A lock-out feature 204 is incorporated within the feed mechanism 202 and prevents dispensing of paper product from the dispenser until certain conditions are satisfied, such as detection of a valid authentication mark 70 as discussed above. Upon initial loading of the paper product formation 14, 80 into the dispenser 16, the digital imager 62 and processor 64 may take an initial digital image 60 of the monitored aspect of the product 14, 80 wherein a pattern recognition algorithm is utilized to ensure that the mark 70 is present on the product. If the mark 70 is not detected, then it can be assumed that the product 14, 80 is not authorized and a signal is sent by the digital imager 64 to the dispenser controller 200, which in turn initiates the lock-out feature 204.

While the present invention has been described in connection with certain preferred embodiments it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method for authenticating a paper product formation dispensed from a dispenser, the method comprising:

loading the paper product formation into the dispenser, the paper product formation having an identification mark engraved into a surface of the paper product formation such that the identification mark has a defined depth into the surface;

within the dispenser, directing incident light onto the surface and capturing a digital image of the surface, wherein the engraved identification mark produces a recognizable static authentication signature in the digital image as a result of distortion or disruption of reflected light from the incident light penetrating into the defined depth of the authentication mark as compared to the surface of the paper product formation adjacent the authentication mark;

analyzing the captured digital image for presence of the authentication signature; and if the authentication signature is not present, the paper product formation is deemed unauthorized and a responsive action is initiated.

2. The method as in claim 1, wherein the identification mark is defined with a laser into the surface of the paper product formation.

3. The method as in claim 2, wherein the dispenser is a rolled product dispenser and the paper product formation is a roll of a continuous paper product, the identification mark defined on a side surface of the roll.

4. The method as in claim 2, wherein the dispenser is a stacked product dispenser and the paper product formation is a stack of folded paper products, the identification mark extending along a side surface of the stack.

5. The method as in claim 1, wherein the identification mark is color-wise indistinguishable from the surrounding surface of the paper product formation.

6. The method as in claim 1, wherein the dispenser is an automatic electronic dispenser, the responsive action including engaging a partial or full lock-out feature wherein the dispenser is disabled from dispensing some or all of product from the paper product formation.

7. The method as in claim 6, wherein the dispenser communicates pending engagement of the lock-out feature to a remote central monitoring station that generates a corrective action call to maintenance personnel.

8. The method as in claim 7, wherein engagement of the lock-out feature is time-delayed so that the maintenance personnel have an opportunity to replace the unauthorized paper product formation with an authentic paper product formation.

9. The method as in claim 1, wherein the digital image is analyzed for dimension or pixel count of the authentication signature and compared with a known dimension or pixel count corresponding to a known authentication mark.

* * * * *